US006157366A

United States Patent [19]

Sharma

[11] Patent Number: 6,157,366

[45] **Date of Patent: *Dec. 5, 2000**

[54] CIRCUITS, SYSTEMS AND METHODS FOR GRAPHICS AND VIDEO WINDOW/DISPLAY DATA BLOCK TRANSFER VIA DEDICATED MEMORY CONTROL

[75] Inventor: Sudhir Sharma, Plano, Tex.

[73] Assignee: Cirrus Logic, Inc.

[ * ] Notice: This patent issued on a continued prosecution application filed under 37 CFR 1.53(d), and is subject to the twenty year patent term provisions of 35 U.S.C. 154(a)(2).

[21] Appl. No.: 08/862,325

[22] Filed: May 23, 1997

Related U.S. Application Data

[63] Continuation of application No. 08/349,894, Dec. 6, 1994, abandoned.

[51] Int. Cl.[7] ..... G09G 5/397

[52] U.S. Cl. ..... 345/118; 345/342

[58] Field of Search ..... 345/118–119, 120–121, 345/189–191, 201, 196, 113, 115, 145, 342; 395/157, 162, 164–166, 405, 412, 417.04, 475, 497.03; 365/189.12, 189.05, 227, 222, 230.02; 348/552; 382/141

[56] References Cited

U.S. PATENT DOCUMENTS

| | | | |
|---|---|---|---|
| 4,642,621 | 2/1987 | Nemoto et al. | 345/118 |
| 4,691,303 | 9/1987 | Churchward et al. | 365/222 |
| 4,805,224 | 2/1989 | Koezuka et al. | 382/141 |
| 4,849,745 | 7/1989 | Satou | 345/191 |
| 4,903,197 | 2/1990 | Wallace et al. | 395/405 |
| 4,961,071 | 10/1990 | Krooss | 345/119 |
| 4,982,345 | 1/1991 | Callahan et al. | 345/118 |
| 5,012,408 | 4/1991 | Conroy | 395/497.03 |
| 5,067,105 | 11/1991 | Borkenhagen et al. | 395/412 |
| 5,117,492 | 5/1992 | Nash | 395/412 |
| 5,159,572 | 10/1992 | Morton | 365/230.03 |
| 5,185,597 | 2/1993 | Pappas et al. | 345/118 |
| 5,193,148 | 3/1993 | Alcorn et al. | 395/157 |
| 5,202,671 | 4/1993 | Aranda et al. | 345/119 |
| 5,245,585 | 9/1993 | Voss et al. | 365/238.5 |
| 5,251,178 | 10/1993 | Childers | 365/227 |
| 5,276,437 | 1/1994 | Horvath et al. | 345/119 |
| 5,278,801 | 1/1994 | Dresser et al. | 365/230.02 |
| 5,353,402 | 10/1994 | Lau | 395/162 |
| 5,442,588 | 8/1995 | Runas | 365/222 |
| 5,457,777 | 10/1995 | Park | 395/164 |
| 5,469,189 | 11/1995 | Noguchi et al. | 345/118 |
| 5,471,577 | 11/1995 | Lightbody et al. | 348/552 |
| 5,473,566 | 12/1995 | Rao | 365/189.12 |
| 5,488,390 | 1/1996 | Reinert et al. | 345/145 |
| 5,500,819 | 3/1996 | Runas | 365/189.05 |
| 5,506,810 | 4/1996 | Runas | 365/230.03 |

*Primary Examiner*—Jeffery Brier

*Attorney, Agent, or Firm*—James J. Murphy, Esq.; Peter Kutkowski, Esq.

[57] ABSTRACT

Display control circuitry is provided which includes a frame buffer 104 having a plurality of memory spaces 301 each for storing a block of display data. Circuitry 200 is provided for generating display position data representing a position on a display screen corresponding to a current display pixel being generated. For each memory space 301, a window control circuit 201 is provided for controlling the transfer of a block of data from the given memory space 301 to a selected window on the display screen. Each window control circuit 201 includes first registers 205, 206 for storing data defining horizontal boundaries of the window, second registers 210, 211 for storing data defining vertical boundaries of the window, and circuitry 207, 208, 209, 212, 213, 214 for comparing the display position data with data stored in the first and second registers and generate an enable signal when the position on the screen of the current pixel is within the window boundaries. Memory control circuitry 300, 302 is provided for retrieving data from the memory space 301 selected in response to the enable signals received from the window control circuits 201.

19 Claims, 3 Drawing Sheets

CIRCUITS, SYSTEMS AND METHODS FOR GRAPHICS AND VIDEO WINDOW/DISPLAY DATA BLOCK TRANSFER VIA DEDICATED MEMORY CONTROL

This is a continuation of application Ser. No. 08/349,894 filed Dec. 6, 1994, now abandoned.

TECHNICAL FIELD OF THE INVENTION

The present invention relates in general to graphics and video data processing and in particular to circuits, systems and methods for controlling the display of blocks of data on a display screen.

CROSS REFERENCE TO RELATED APPLICATIONS

The following copending and coassigned United States patent application contains related material and is incorporated herein by reference:

U.S. patent application Ser. No. 08/098,844, entitled "Apparatus, Systems And Methods For Displaying A Cursor On A Display Screen," filed Jul. 29, 1993, now U.S. Pat. No. 5,488,390.

BACKGROUND OF THE INVENTION

Bit block transfer (BitBLT) is an important performance enhancement technique used in digital data processing, graphics and video applications, and in particular in "windowing" applications. In general, in a bit block transfer ("block move"), an entire block of data (also known as bitmaps) is transferred from a first (source) block of storage locations in display memory to a second (destination) block of storage locations in display memory. In graphics systems BitBLTs can improve operational speed since the data transfers typically remain local to graphics controller thereby reducing the tasks required to be performed by the CPU. Similarly, entire blocks of data may be copied from a set of source locations in memory to a set of destination locations in memory by a block copy.

There are a number of known techniques for implementing bit block transfers (copies). For example, a block of source locations in memory may be identified by the addresses corresponding to a pair of "corners" of the block (or two pairs of corners if the block is a rectangle); the address of one "corner" defining a starting row and a starting column address, and the address of a second corner defining an ending row and an ending column address. Once the starting and ending addresses for the block are specified, the remaining source addresses can be derived therefrom using counters and associated circuitry. The destination block can similarly be identified. It should be noted that there are other known techniques of identifying a block of storage locations, such as defining a single starting address ("corner") and the size ("dimensions") of the block being moved or copied. To implement the actual transfer, the BitBLT circuitry and software sequence through the source addresses and each word in the identified source block is moved (or copied) from its source address and sent to a corresponding destination address. In essence, typical bit block transfer techniques read data from the source block of memory locations a word or byte at a time and then write that data into the destination block of memory a word or byte at a time. It should also be noted that some BitBLT implementations can perform more sophisticated operations which cross "byte" boundaries in a word.

In windowing display systems, bit block transfers are often used when blocks ("windows") of information are transferred from one position on the display screen to another position on the display screen, such as when a data window is dragged across the screen by a mouse, or a "window" on a screen is "processed" for some specific application. In this case, the bit block transfer circuitry and software move the corresponding pixel data in the frame buffer (display memory) from the address space corresponding to the original position on the display screen to the address space corresponding to the new position on the display screen. The bit block transfer allows pre-existing pixel data to be used to generate data on the display screen thereby eliminating the need for the system CPU to regenerate the same pixel data to define the same image on the screen. Similarly, bit block transfers can be used when blocks of information are being copied on the display screen. In this case, the corresponding pixel data is replicated by the bit block transfer circuitry and software and written into one or more additional address spaces of the frame buffer corresponding to the new areas of the display screen to which the original displayed data is being copied. As is evident from the above discussion, the ability of presently available display control systems to efficiently move and copy windows of data being displayed on a display screen is limited by the fact that such systems must physically move data within the display memory (frame buffer). The speed of such operations is particularly impacted since these systems typically move/copy data on a byte-by-byte or word-by-word basis. Thus, the need has arisen for improved circuits, systems, and methods for controlling the display of blocks (windows) of data on a display screen. In particular, such circuits, systems, and methods should eliminate the inefficiencies found in the word-by-word memory transfers found in currently available systems.

SUMMARY OF THE INVENTION

According to the general principles of the present invention, blocks of either graphics or video data are stored in designated memory spaces within a frame buffer. A given block of data is then retrieved from the corresponding memory space to generate a window on the display screen of a display device when the raster scan generating the display reaches the screen position assigned that window. When a window is to be moved on the display screen, such as when a window is "dragged" across the screen by a mouse, the corresponding data is retrieved from the same memory space when the raster scan approaches the new screen position rather than being moved within the frame buffer itself. In other words, no time-intensive word-by-word movement of data within the frame buffer is required.

According to a first embodiment according to the principles of the present invention, display control circuitry is provided which includes a frame buffer having a plurality of memory spaces each for storing a block of display data. Circuitry is provided for generating display position data representing a position on a display screen corresponding to a current display pixel being generated. For each memory space, a window control circuit is provided for controlling the transfer of a block of data from a corresponding memory space to a selected window on the display screen. Registers for storing data defining horizontal boundaries of the window, second registers for storing data defining vertical boundaries of the window, and circuitry for comparing the display position data with the data stored in the first and second registers to generate an enable signal when the position on the screen of the current pixel is within the window boundaries. Also included in the display control circuitry is memory control circuitry for retrieving data from a one of the memory spaces selected in response to the enable signal received from each of the window control circuits.

According to a second embodiment according to the principles of the present invention, display control circuitry is provided which includes a frame buffer partitioned into a plurality of memory spaces each for storing a block of pixel data for generating a window on a display screen. A first counter is included for determining an x-position on the screen of a current pixel being generated by counting the periods of a pixel clock timing the generation of each line of pixels on the screen. A second counter is provided for determining a y-position on the screen of the current pixel by counting the generation of each line of pixels on the screen. First storage circuitry stores data defining horizontal position and width of a corresponding display window. Second storage circuitry stores data defining display vertical position and height of the corresponding window. First position control circuitry determines when the current pixel falls within the x-boundaries of the window by comparing a count from the first counter with the data stored in the first storage circuitry. Second position control circuitry determines when the current pixel falls within the y-boundaries of the window by comparing a count output from the second counter with the data stored in the second storage circuitry. Circuitry is provided for generating an enable signal when the current pixel falls within both the x-boundaries and the y-boundaries of the window. Circuitry is also provided for retrieving a word of pixel data from the memory space corresponding to the display window in response to at least the enable signal. The display control circuitry is operable to provide for the movement of the window on the display screen through the reprogramming of data in at least one of the first and second circuitries for storing.

According to a third embodiment, a display system is provided which includes a central processing unit, a display unit, and a frame buffer. The frame buffer includes a plurality of memory spaces each for storing a block of data defining a data window to be displayed on a screen of the display unit. The display controller includes circuitry for generating display position data representing the position on the display screen of a current pixel being generated and for each memory space in the frame buffer, a window control circuit for controlling the transfer of a block of data from that memory space to a corresponding window on the display screen. Each window control circuit includes first registers for storing data defining horizontal boundaries of the window, second registers for storing data defining vertical boundaries of the window, and circuitry for comparing the display position data with data stored in the x-position and y-position registers to generate an enable signal when the position on the screen of the current pixel is within the window boundaries. The display controller also includes memory control circuitry for retrieving data from a one of the memory spaces selected in response to the enable signal received from each of the window control circuits. According to the principles of the present invention, the central processing unit is operable to change a position on the display screen of a selected one of the windows by changing the data stored in at least one of the first and second registers of the control circuitry corresponding to the selected window.

The principles of the present invention also provide for methods of controlling the display of windows of data on a display screen. According to one method, a block of data defining a window to be displayed on a display screen is stored in a frame buffer including at least one memory space for storing such a block of display data. Display position data is generated including x-display position and y-display position data representing a position on the display screen corresponding to a current display pixel being generated. X-boundary data, including x-position data defining a horizontal position of a reference pixel on the screen and x-size data defining a width of the window is stored. Also stored is y-boundary data including y-position data defining a vertical position of the reference pixel on the screen and. y-size data defining a height of the window. The display position data is compared with the stored x- and y-boundary data to generate an enable signal when the position on the screen of the current pixel is within the window boundaries. Data from one of the memory spaces selected in response to the enable signal is retrieved. The position on the display screen of the window can then be changed by changing at least some of the stored x- and y-boundary data.

Circuits, systems and methods embodying the principles of the present invention have substantial advantages over the prior art. In particular, such circuits, systems and methods eliminate the deficiencies in the word-by-word memory transfers used in currently available systems to implement the block movement of data on a display screen.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
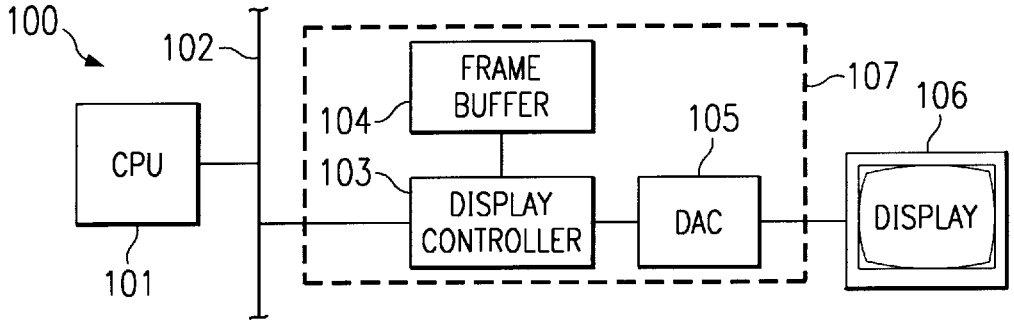
FIG. 1 is a high level functional block diagram of a graphics/video processing system embodying the principles of the present invention.
Figure 2:
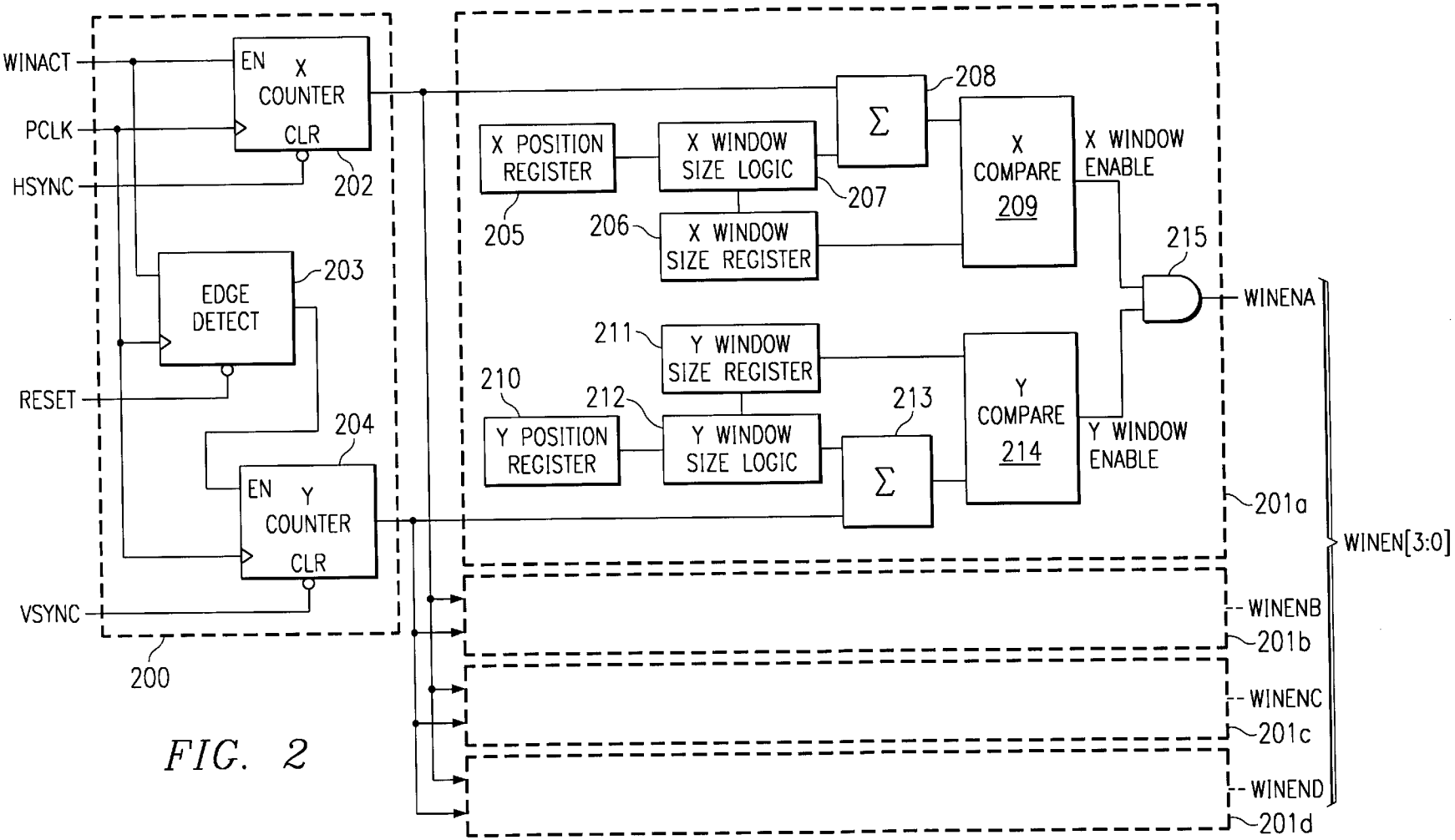
FIG. 2 is a more detailed functional block diagram of the window display control circuitry within the display controller of FIG. 1.
Figure 3:
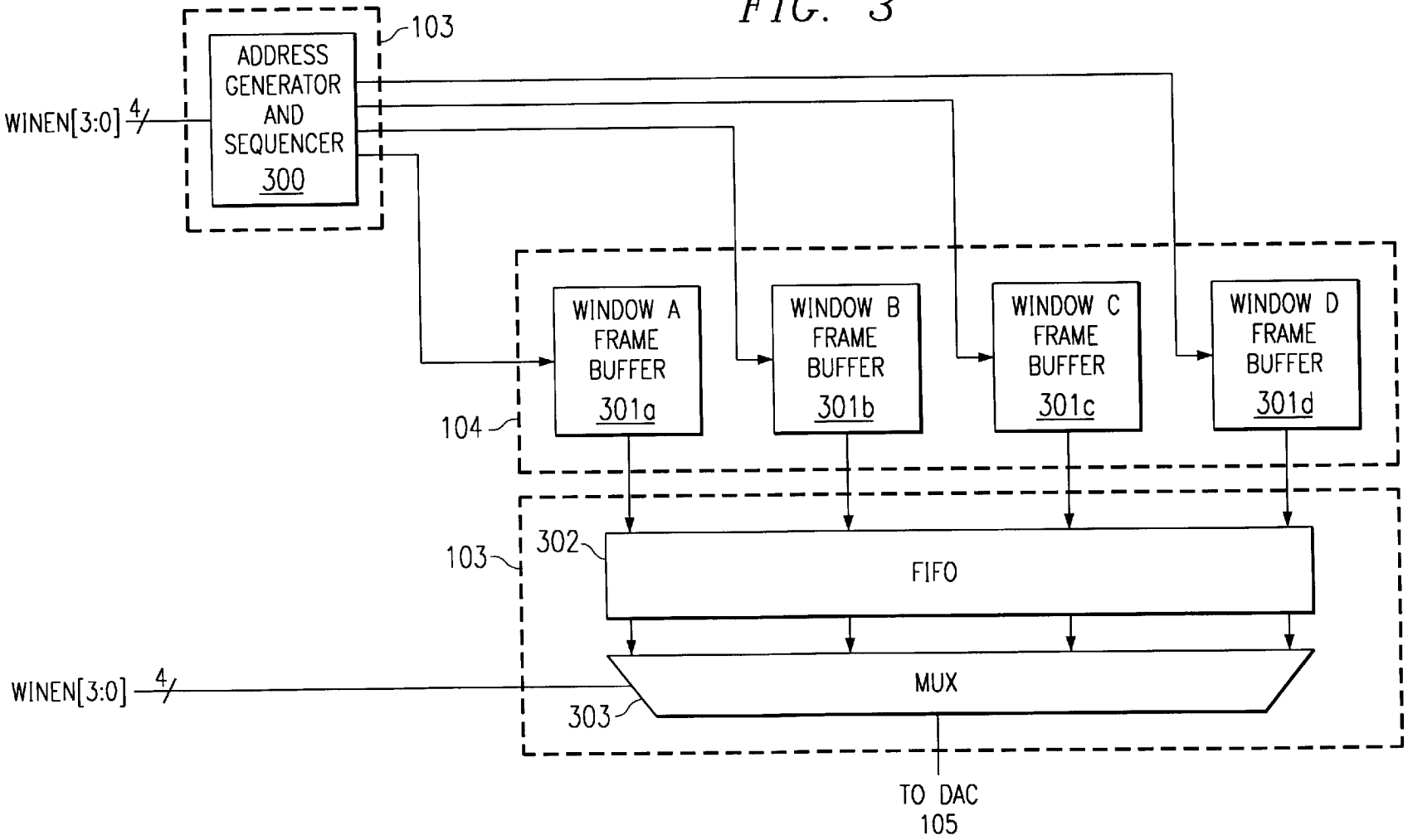
FIG. 3 is a more detailed functional block diagram of the frame buffer/display unit interface circuitry within the display controller of FIG. 1.

The principles of the present invention and their advantages are best understood by referring to the illustrated embodiment depicted in FIGS. 1–3 of the drawings, in which like numbers designate like parts. Further, while the principles of the present invention will be illustrated within the context of a graphics/video processing system, block transfer circuits, systems and methods according to these principles may be employed in any one of a number of processing applications.

FIG. 1 is a high level functional block diagram of the portion of a processing system 100 controlling the display of graphics and/or video data. System 100 includes a central processing unit 101, a system bus 102, a display controller 103, a frame buffer 104, a digital-to-analog converter (DAC) 105 and a display device 106. Display controller 103 may be an integrated video and graphics controller or complemented by separate graphics and video controllers. Similarly, frame buffer 104 may be a shared (unified) video/graphics frame buffer or implemented by separate video and graphics frame buffers. In the preferred embodiment, frame buffer 104, display controller 103 and DAC 105 are fabricated as a single integrated circuit 107.

CPU 101 controls the overall operation of system 100, determines the content of any graphics data to be displayed on display unit 106 under user commands, and performs various data processing functions. CPU 101 may be for example a general purpose microprocessor used in commercial personal computers. CPU 101 communicates with the remainder of system 100 via system bus 102, which may be for example a local bus, an ISA bus or a PCI bus. DAC 105 receives digital data from controller 103 and outputs in response the analog data required to drive display device 106. Depending on the specific implementation of system 100, DAC 105 may also include a color palette, YUV to RGB format various circuitry, and/or x- and y-zooming circuitry, to name a few options.

Display 106 may be for example a CRT unit, liquid crystal display, electroluminescent display (ELD), plasma display (PLD), or other type of display device which displays images on a display screen as a plurality of pixels.

In the illustrated embodiment, system 100 is a VGA system driving a display screen on display 106 of 640 columns by 480 rows of pixels. Also for purposes of illustration, each pixel will be assumed to be defined by 24-bits of RGB (true color) data (i.e., 8-bits each for red, green, and blue). Thus, the absolute maximum size of the physical memory of frame buffer 104 will be 640 columns by 480 rows by 24-bits per pixel or approximately one megabyte. It should be noted that the "visual pixels" on the display screen may or may not exactly map to the storage locations in the physical memory of frame buffer 104, depending on the memory formatting selected. Further, all 24-bits of color data defining each pixel may be physically stored in sequential storage locations in physical memory (in which case, all 24-bits could be stored in a given page of a DRAM or VRAM) or may be stored in three different banks or rows of the physical memory of the frame buffer 104.

According to the principles of the present invention, blocks of graphics or video data are stored in designated memory spaces within frame buffer 104. A given block of data is then retrieved from the corresponding memory space to generate a window on the screen of display 106 when the raster scan generating the display reaches the screen position assigned that window. When a window is moved on the display screen such as by "dragging" the window with a mouse, the corresponding block of data is retrieved from the same memory space when the raster scan approaches the new screen position rather than being moved within the frame buffer itself. No time-intensive movement of data within the frame buffer 104 is required. A preferred embodiment of the circuitry for implementing such block transfers is depicted in FIGS. 2 and 3. Preferably, the circuitry of FIGS. 2 and 3 is disposed within display controller 103, however, in alternate embodiments such circuitry may be disposed elsewhere within the architecture of system 100.

Figure 4:
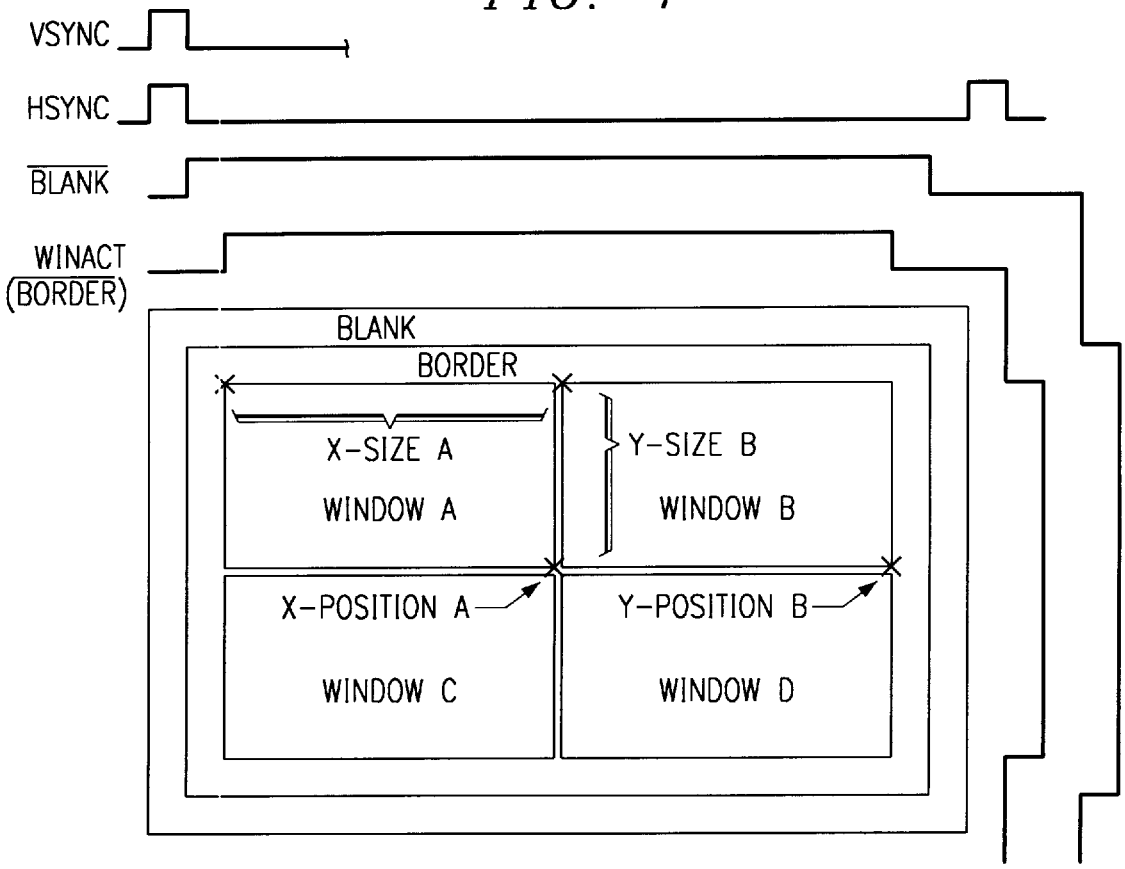
FIG. 4 is a diagramic representation of the timing relationship between selected display control signals and the resulting display of a selected number of windows in the nonoverlapping case.

In the illustrated embodiment, frame buffer 104 is assumed to be partitioned into four different window memory spaces each of which may be used to store data for the generation of a corresponding one of four display windows on the screen of display 106. FIG. 4 illustrates the case where all four windows are being displayed with no overlap on the screen of display unit. It should be noted at this point, that according to the principles of the present invention, the memory space of frame buffer 104 may be partitioned into varying numbers of spaces for driving a correspondingly varying number of display windows, four "windows" shown in the present example for convenience. It should also be noted that not all available memory spaces within frame buffer 104 need be loaded with window data nor that a window be generated at all from data which is loaded into a given memory space.

The control circuitry of FIG. 2 includes common control circuitry 200 which operates during the control of all windows being processed. Each window (and the retrieval of data from the corresponding memory space) being controlled is associated with a dedicated block of circuitry 201. In the illustrated embodiment where up to four windows may be generated, there are four blocks of dedicated control circuitry 201*a*–201*d*. For brevity and clarity, the detail of selected block 201*a* is shown. In alternate embodiments where a different number of windows are being controlled, the number of blocks and circuitry 201 correspondingly differs.

Common control circuitry 200 includes an x-position counter 202, a y-position counter 203 and an edge detector 204. Common control circuitry 200 in general keeps track of the display position of current pixel data being pipelined from the frame buffer 104 to the screen of display 106. More particularly, x-counter 202 tracks the x display position (i.e., the position along the current display line) of the pixel data currently being pipelined, while y-counter 204 determines which display line (i.e., y display position) is currently being generated.

X-counter 202 is enabled by the signal WINACT, the timing relationship in relation to the generation of the display screen is depicted in FIG. 4 (as will be discussed below in conjunction with FIG. 3, counters 202 and 204 in the preferred embodiment anticipate the arrival of WINACT by a number of pixel clock periods in order to account for the delay through output FIFO at the backend). Control signal WINACT, which is generated within display controller 103, is active (high) when the raster scan has the active area of the display screen. The active area of the display screen is defined as that area within both the blanked area of the screen and the border region (if any). X-counter 202, when enabled, increments with the pixel clock (PCLK) which times transfer of words of pixel data from the frame buffer 104 to the display unit 106. Counter 202 is reset with each horizontal synchronization signal (HSYNC) which signals the start of the rastering of data for each new line of pixels on the display screen. In sum, X-counter 202 tracks the display position current pixel of the current line being rastered from frame buffer 104 to display 106 by counting the periods of the pixel clock timing those transfers.

Y-position counter 204 is enabled on the next pixel clock after control signal WINACT goes high. The enable signal is maintained high for approximately one pixel clock by edge detector 203. On the rising edge of the very next pixel clock, just before the enable signal returns low, y-counter 204 increments. Y-counter 204 is cleared which each vertical synchronization signal (VSYNC) which indicates the start of the generation of each new display frame. In sum, Y-counter 204 tracks the current display line being generated by counting the rising edge of control signal WINACT occurring at the start of each new line of the active display area.

Each window control circuit 201 is programmed by the user through CPU 101 to control (designate) the position on the display screen of a corresponding block of data as a display window. The circuitry of each window control circuit 201 used to control the x (horizontal) display position of the corresponding window includes an x-position register 205, an x-window size register 206, x-window size logic 207, summation (adder) circuitry 208 and x-compare circuitry 209. The circuitry of each window control circuit 201 used to control the y-position of the corresponding display window includes y-position register 210, y-window size register 211, y-window size logic 212, summation (adder) circuitry 213 and y-compare circuitry 214. The outputs of the x-compare circuitry 209 and y-compare circuitry 214 are combined by an AND gate 215 to generate a window enable signal WINEN which is used to control retrieval of the block of data from the corresponding memory space to generate the display window, as discussed below.

X-position register 205 is programmed with a value 205 which designates the position on the display screen of the lower righthand corner of the corresponding window. For illustration purposes, the value X-POSITION A, which is the point represented by which the value loaded into x-position register 205 of circuitry 201*a* dedicated to window A, is depicted in FIG. 4. X-window size register 206 is loaded with a value which designates the width (i.e., distance along a display line, preferably in number of pixels) of the corresponding window. For illustration purposes, the value X-SIZE A, which is the screen width represented by the value loaded into x-window size register 206 of circuitry 201*a* for window A, is depicted in FIG. 4 for display window A. The raster scan is within the horizontal (x) boundaries of the corresponding window when the count in counter 202 is greater than or equal to the value in x-position register 205 minus the value in x-size register 206 and is less than or equal to the value in x-position register 205 (i.e., $0 \leqq$ count X+(x-size−x-position)<x-size). Thus, x-window size logic 207 subtracts the value in x-position register 205 from the value in x-window size register 206. The present count in x-counter 202 is then added by adders 208 to the value (difference) calculated by x-window size logic 207, the resulting sum provided to one input x-compare circuitry 209. X-compare circuitry 209 then compares the output of summation circuitry 208 with the value in x-window size register 206. X-compare circuitry 209 determines when the output of summation circuitry 208 (SUM X) is greater than or equal to zero and less than or equal to the value in x-window size register 206, such current pixel value falls within the x-dimension of the corresponding display window. When these conditions are met, x-compare circuitry 209 outputs an active signal (high).

Y-position register 210 is loaded with a value designating the y-screen position of the lower righthand corner of the screen position of the corresponding window. For illustrative purposes, the value Y-POSITION B, which is the point represented by value loaded into y-position register 210 of circuitry 201*b* for window B, is shown in FIG. 4. The y-window size register 211 is loaded with a value representing the y-dimension (height) of the corresponding window, preferably in number of display lines. The dimension Y-SIZE B, which is the screen height represented y the value loaded into y-size register 212 of circuitry for window B, is shown in FIG. 4 for reference. The raster scan is within the y display boundaries of the corresponding window when the count in y-counter 204 is greater than or equal to the value in y-position register 210 minus the value in y-size register 212 and is less than or equal to the value in y-position register 210 (i.e., $0 \leqq$ count Y+(y-size−y-position)<y-size). Thus, y-window size logic 212 subtracts the value in y-position register 210 from the value in y-window size register 211. The count in y-counter 204 is then summed with the output (difference) of y-window size logic 212 to obtain a value which is presented to one input of y-compare circuitry 214. The second input to y-compare circuitry 214 is coupled to the y-window size register 211. The output of summation circuitry 213 (SUM Y) and the value in y-window size register 211 are then compared by y-compare circuitry 214, and when SUM Y is greater than or equal to zero and less than or equal to the value in y-window size register 211, then the current pixel is within the boundaries of the corresponding window and an active (high) output is generated.

When the outputs of x-compare circuitry 209 and y-compare circuitry 214 are both active, the current pixel falls within both the x and y boundaries, the corresponding window and the control signal WINEN is generating and output.

FIG. 3 depicts the interface between display controller 103, frame buffer 104, and DAC 105 according to the principles of the present invention. The window enable (WINEN) lines from each of the dedicated window control circuits 201 are provided to the address generator and sequencer circuitry 300 of the display controller 103. Frame buffer 104 is shown partitioned into four memory spaces 301*a–b*, each for storing a block of data for generating a display window A-B (FIG. 4). Address generator/sequencer 300 generates addresses to the address space 301 corresponding to the display window enabled by the window enable signals WINEN [3:0]. It should be noted, in the preferred embodiment, the memory space 301 for each window is provided by a separate memory device constructing frame buffer 104. In alternate embodiments, two or more window memory spaces may be provided within the physical memory space of a single memory device. Blocks of data are written into the memory spaces 301 in a conventional manner.

Data from the activated memory area is queued in output FIFO 302. According to the principles of the present invention, window control circuitry 200 anticipates the arrival of the active period of control signal WINACT such that FIFO 302 is already filled and no delay occurs when display unit 106 is ready for pixel data. For example, assuming that FIFO 302 is sixteen pixel words in length, then x-counter 202 and y-counter 204 start counting sixteen pixel clocks before the start of the active period of WINACT and continue to count sixteen pixel clocks ahead of the rastering of data to display unit 106. In this fashion, the sixteen pixel clock delay through FIFO is accounted for.

It should be noted that sequencer/address generator circuitry 300 preferably includes arbitration logic to control instances where active WINEN [3:0] signals are generated for two or more windows simultaneously. In this instance, two or more display windows are overlapping, in whole or in part, with the arbitration logic (under CPU control) determining which window is on top (i.e., displayed). The output from FIFO 302 is provided to the input of multiplexer

303. Multiplexer 303 passes data from the activated frame buffer memory space 301 in accordance with the window enable signals WIN [3:0] received at its control inputs. The output of multiplexer 303 is passed to DAC 105.

According to the principles of the present invention, a block of data (object) can be moved from one position on the display screen to another position on the display screen by simply reloading x-position register 205 and y-position register 210 in the corresponding dedicated control circuitry 201. Further, using x-window size register 206 and/or y-window size logic 212, the size of the corresponding window on the display screen can be defined or redefined (in some cases not all the available memory of the corresponding memory space 301 may be used to generate a window).

Although the present invention and its advantages have been described in detail, it should be understood that various changes, substitutions and alterations can be made herein without departing from the spirit and scope of the invention as defined by the appended claims.

What is claimed is:

1. Display control circuitry comprising:

a frame buffer including a plurality of memory spaces, each for storing a block of display data;

circuitry for generating display position data representing a position on a display screen corresponding to a current display pixel being generated;

for each said memory space, a window control circuit for controlling the transfer of a block of data from said memory space to a selected window on said display screen comprising:

first registers for storing data defining horizontal boundaries of said window;

second registers for storing data defining vertical boundaries of said window; and circuitry for comparing said display position data with data stored in said first and second registers to generate an enable signal when said position on said screen of said current pixel is within said window boundaries;

memory control circuitry retrieving data from a one of said memory spaces selected in response to a said enable signal received from each of said window control circuits; and a first-in-first-out register for queuing data output from said one of said memory spaces selected in response to said enable signal.

2. The display control circuitry of claim 1 wherein said circuitry for comparing a value in the horizontal-size resister and determining whether said current pixel is within said horizontal boundary comprises horizontal-position comparison circuitry including:

circuitry for subtracting a value held in said horizontal-position register from a value held in said horizontal-size register;

circuitry for adding an output of said circuitry for subtracting to horizontal-position data for said current pixel from said circuitry for generating; and circuitry for comparing a sum output from said circuitry for adding with said value held in said horizontal-size register and outputting an horizontal-position enable signal in response when said sum is greater than or equal to zero and less than or equal to said value in said horizontal-size register.

3. The display control circuitry of claim 1 wherein said circuitry for comparing a value in the vertical size register and determining whether said current pixel is within said vertical boundary comprises vertical-position comparison circuitry including:

circuitry for subtracting a value held in said vertical-position register from a value held in said vertical-size register;

circuitry for adding an output of said circuitry for subtracting to vertical-position data for said current pixel from said circuitry for generating; and circuitry for comparing a sum output from said circuitry for adding with said value held in said vertical-size register and outputting a vertical-position enable signal in response when said sum is greater than or equal to zero and less than or equal to said value in said vertical-size register.

4. The display control circuitry of claim 1 wherein said memory control circuitry further includes an output multiplexer for selecting for output data from said selected memory space in response to said enable signal.

5. The display control circuitry of claim 1 wherein each said memory space of said frame buffer is disposed within a separate memory device.

6. Display control circuitry comprising:

a frame buffer partitioned into a plurality of memory spaces each for storing a block of pixel data for generating a window on a display screen;

a first counter for determining an x-position on said screen of a current pixel being generated by counting the periods of a pixel clock timing the generation of each line of pixels on said screen;

a second counter for determining a y-position on said screen of said current pixel by counting the generation of each said line of pixels on said screen;

first storage circuitry for storing data defining display horizontal position and width of a corresponding said window;

second storage circuitry for storing data defining display vertical position and height of said corresponding window;

first position control circuitry for determining when said current pixel falls within x boundaries of said window by comparing a sum of a count from said first counter and a difference between said width and horizontal position data stored in said first storage circuitry with said width data;

second position control circuitry for determining when said current pixel falls within y boundaries of said window by comparing a sum of a count output from said second counter and a difference between said height and vertical position data stored in said second storage circuitry with said height data;

circuitry for generating an enable signal when said current pixel falls within both said x boundaries and said y boundaries of said window;

circuitry including address generation circuitry for retrieving a word of pixel data from a said memory space corresponding to said display window in response to at least said enable signal;

first-in-first-out circuitry for queuing said word of pixel data retrieved from said memory space; and wherein said display control circuitry is operable to provide for the movement of said window on said display screen through the reprogramming of data in at least one of said first and second circuitry for storing.

7. The display control circuitry of claim 6 wherein said first and second circuitry for storing data comprise at least one register.

8. The display control circuitry of claim 6 wherein said circuitry for generating an enable signal comprises an AND gate.

9. The display control circuitry of claim 6 wherein said data stored in said first storage circuitry defining said horizontal position of said window represents a position of a reference pixel at a selected corner of said window.

10. The display control circuitry of claim 6 wherein said data stored in said second storage circuitry defining said vertical position of said window represents a position of a reference pixel at a selected corner of said window.

11. The display control circuitry of claim 6 wherein said first position control circuitry comprises x-window position control circuitry operable to:

subtract said display horizontal position data from said width data to generate a difference;

add the difference to the count in said first counter to generate a sum; and compare the sum with said width data and generate an x enable signal when said sum is greater than or equal to zero and less than or equal to said width data.

12. The display control circuitry of claim 6 wherein said second position control circuitry comprises y-position control circuitry operable to:

subtract said display vertical position data from said height data to generate a difference;

add the difference to the count in said second counter to generate a sum; and compare the sum with the height data and generate a y enable signal when said sum is greater than or equal to zero and less than or equal to said height data.

13. A display system comprising:

a central processing unit;

a display unit;

a frame buffer including a plurality of memory spaces each for storing a block of data defining a data window to be displayed on a screen of said display unit;

a display controller comprising:

circuitry for generating display position data representing a position on a display screen corresponding to a current display pixel being generated;

for each said memory space, a window control circuit for controlling the transfer of a said block of data from said memory space to a corresponding said window on said display screen comprising:

first registers for storing data defining horizontal boundaries of said window;

second registers for storing data defining vertical boundaries of said window; and circuitry for comparing said display position data with data stored in said x-position and y-position registers to generate an enable signal when said position on said screen of said current pixel is within said window boundaries;

memory control circuitry for retrieving data from a one of said memory spaces selected in response to said enable signal received from each of said window control circuits;

a first-in-first-out register for queuing data retrieved from said one of said memory spaces selected in response to said enable signal; and wherein said central processing unit is operable to change a position on said display screen of a selected said window by changing data stored in at least one of said first and second registers of said window control circuitry corresponding to said selected window.

14. The system of claim 13 wherein said blocks of data stored in said memory spaces of said frame buffer comprise graphics data.

15. The system of claim 13 wherein said blocks of data stored in said memory spaces of said frame buffer comprise video data.

16. The system of claim 13 wherein said central processing unit is operable to change the size of a selected said window by changing data stored in at least one of said first and second registers of said window control circuitry corresponding to said selected window.

17. A method of controlling the display of a window of data comprising the steps of:

storing a block of data defining a window to be displayed on a display screen in a frame buffer including at least one memory space for storing a block of display data;

counting periods of a pixel clock timing display generation to generate display position data including current x-display position and current y-display position data representing a position on a display screen corresponding to a current display pixel being generated;

storing x-boundary data including x-position reference data defining a horizontal position of a reference pixel on the screen and x-size data defining a width of the window;

storing y-boundary data including y-position reference data defining a vertical position of the reference pixel on the screen and y-size data defining a height of the window;

comparing the display position data with stored x- and y-boundary data to generate an enable signal when the position on the screen of the current pixel is within the window boundaries said step of comparing comprising the substeps of;

comparing the sum of the current x-position data and the difference between the x-size data and the x-position reference data with the x-size data to determine whether the current pixel is within the x-boundary; and comparing the sum of the current y-position data and the difference between the y-size data and the y-position reference data with the y-size data to determine whether the current pixel is within the y-boundary;

retrieving data from one of the memory spaces selected in response to the enable signal;

queuing the data retrieved from the one of the memory spaces in a first-in-first-out register; and changing a position on the display screen of the window by changing at least some of the stored x- and y-boundary data.

18. The method of claim 17 wherein said step of comparing includes the substeps of:

subtracting the x-position data from the x-size data;

adding a result of said step of subtracting to the x-position data for the current pixel; and comparing a result of said step of adding with the x-size data and outputting an x-position enable signal in response when the result is greater than or equal to zero and less than or equal to said value in said x-size data.

19. The method of claim 18 wherein said step of comparing includes the substeps of:

subtracting the y-position data from the y-size data;

adding a result of said step of subtracting to the y-position data for the current pixel; and comparing a result of said step of adding with the y-size register and outputting an y-position enable signal in response when the result is greater than or equal to zero and less than or equal to the y-size data.

* * * * *